US008261830B2

(12) United States Patent
Xu

(10) Patent No.: US 8,261,830 B2
(45) Date of Patent: Sep. 11, 2012

(54) FISHING TOOL AND METHOD

(75) Inventor: Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/873,568

(22) Filed: Sep. 1, 2010

(65) Prior Publication Data

US 2012/0048553 A1 Mar. 1, 2012

(51) Int. Cl.
*E21B 31/00* (2006.01)

(52) U.S. Cl. ..... 166/301; 166/98; 166/99

(58) Field of Classification Search ..... 166/301, 166/98, 99

See application file for complete search history.

(56) References Cited

U.S. PATENT DOCUMENTS

| | | | | |
|---|---|---|---|---|
| 3,168,140 | A * | 2/1965 | Bodine, Jr. | 166/301 |
| 5,361,830 | A | 11/1994 | Wicks, III et al. | |
| 6,502,638 | B1 | 1/2003 | Stoesz | |
| 2005/0257931 | A1 | 11/2005 | Mody et al. | |

FOREIGN PATENT DOCUMENTS

| | | | |
|---|---|---|---|
| JP | 5157598 | A | 6/1993 |
| WO | 2004057149 | A1 | 11/1994 |

OTHER PUBLICATIONS

Raghavan A. Kumar et al., "Passive Control of Vortex-Induced Vibrations: An Overview"; School of Mechanical Engineering, Kyungpook National University, Aug. 20, 2007 pp. 1-11.

International Search Report and Written Opinion; Date of Mailing Feb. 24, 2012; International Application No. PCT/US2011/046433; Korean Intellectualy Property Office; International Search Report 5 pages; Written Opinion 5 pages.

* cited by examiner

*Primary Examiner* — Kenneth L Thompson
*Assistant Examiner* — Yong-Suk (Philip) Ro
(74) *Attorney, Agent, or Firm* — Cantor Colburn LLP

(57) ABSTRACT

A fishing tool includes a grapple and an exciter in vibration transmissive communication with the grapple and method.

15 Claims, 2 Drawing Sheets

FISHING TOOL AND METHOD

BACKGROUND

Fishing is a well known vernacular term in industries involved in subterranean drilling and completion activities. Fishing related to the removal from a borehole of a tool that has been dropped or become stuck. Clearly downhole operations of any type can be significantly impeded by a tool in the borehole that does not belong there and hence it is in the interest of operators to remove such "fish" from the borehole.

Over the years the industry has produced many different tools and methods for fishing but it is well known to those in the industry that the possibilities of parameters of a particular fish are endless and accordingly the industry is always receptive to new tools and methods for fish retrieval.

SUMMARY

Disclosed herein is a fishing tool that includes a grapple and an exciter in vibration transmissive communication with the grapple.

Further disclosed herein is a method for retrieving a stuck fish in a borehole that includes running a fishing tool that includes a grapple and an exciter in vibration transmissive communication with the grapple into a borehole having a stuck fish. The method further includes engaging the fish and actuating the exciter after which the fish is vibrated.

BRIEF DESCRIPTION OF THE DRAWINGS

Referring now to the drawings wherein like elements are numbered alike in the several Figures.

DETAILED DESCRIPTION

Figure 1:
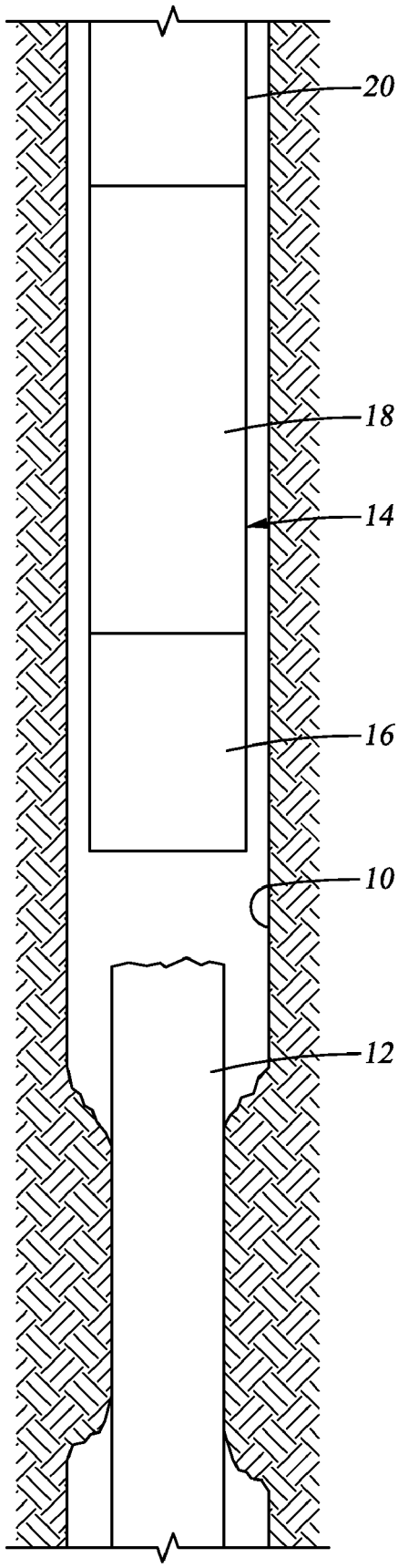
FIG. 1 is a schematic view of a fish in a borehole and a fishing tool according to the disclosure herein just prior to engaging the fish.

Referring to FIG. 1, a schematic representation of a borehole 10 having a "fish" 12 therein and a fishing tool 14 is illustrated. One of ordinary skill in the art will recognize these features. The fishing tool comprises a grapple 16, of any known type, that is capable of gripping the fish 12. The grapple 16 may be of an ID type or an overshot type and will allow an operator to reliably secure the fishing tool 14 to the fish 12.

Schematically illustrated adjacent the grapple 16 is an exciter 18 capable of providing excitation to the fishing tool 14 to enhance fish recovery. The exciter 18 will be addressed further hereunder with reference to FIGS. 2 and 3. Finally, one of skill in the art will note the string 20 on which the fishing tool 14 is run in the hole and with which the fish 12 is retrieved from the hole.

Figure 2:
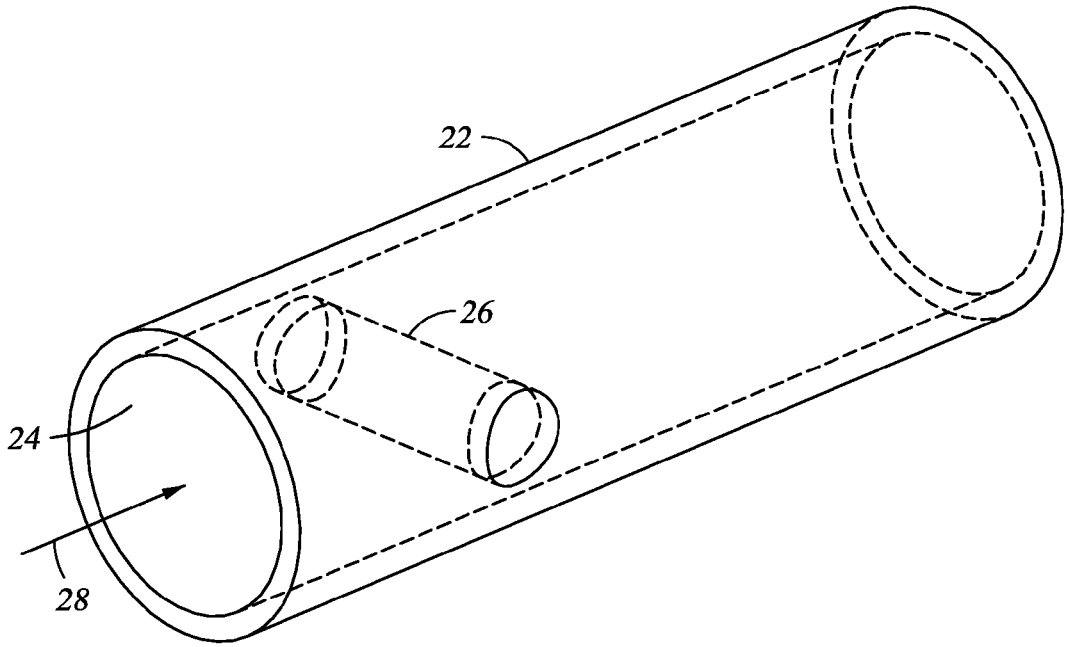
FIG. 2 is a schematic perspective view of a vibration component of the fishing tool shown in FIG. 1.
Figure 3:
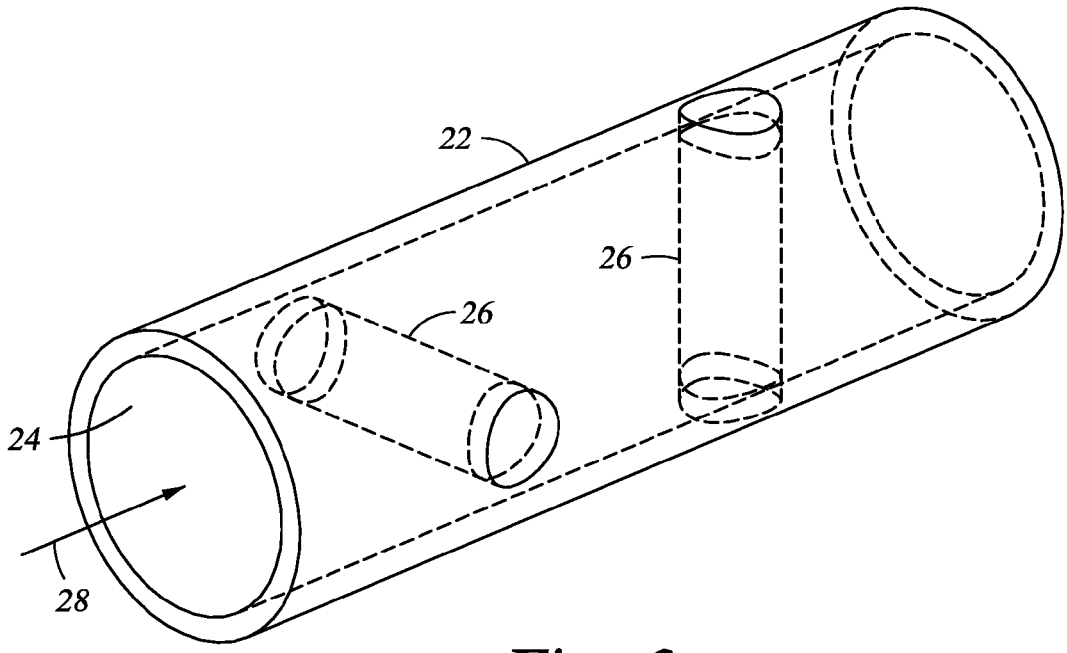
FIG. 3 is a schematic perspective view of an alternate embodiment of the vibration component of the fishing tool shown in FIG. 1.

Referring now to FIGS. 2 and 3, the exciter is illustrated relatively schematically and with an outer housing 22, defining a flow channel 24 therewithin, and illustrated transparently, in two embodiments. In the first embodiment, illustrated in FIG. 2, it will be appreciated that a rod 26 extends transversely (crosswise but not necessarily at right angles to an axis of the housing) of the housing 22. The rod 26 may be at an angle other than 90 degrees to the housing 22. The rod 26 should have a cross sectional geometry of circular, square, diamond shaped, trapezoidal triangular, square with round corners, etc. Most cross sectional shapes will work provided they are not specifically capable of parting and rejoining a flow without vortex shedding. Vortex shedding is required in the embodiments disclosed. It is further noted that the rod can be hollow; and that the cross section need not necessarily be uniform along its length. The rods can be tapered or can simply change geometry over their lengths. Each rod among multiple rods can also be of differing geometry. The cross sectional area of each rod is in the range of about 10 to about 80 percent of the cross sectional area of the channel. Material of the rod 26 should be of a relatively high modulus such as metal or ceramic to inhibit vibrational absorption in the material of the rod itself. Rather it is desirable to transfer as much of the vibrational energy as possible to the housing. The rod 26 should be mounted rigidly or otherwise to effect the greatest transfer of the vibrational energy to the housing. This produces a greater amplitude vibration in the housing per unit flow volume per minute and Reynolds number. Some embodiments will have surface smoothness to enhance vortex shedding.

The rod 26 when disposed in a flowing fluid 28, will tend to develop vortices that form and release from each side of the rod 26. The formation of a vortex on one side of the rod 26 tends to pull the rod 26 in that direction and also pull flow from the other side of the rod 26 into the vortex. The pulled in fluid will then tend to cut off the first formed vortex as the second formed vortex grows. With growth of the second formed vortex, the fluid will tend to pull the rod 26 in the direction of the second vortex. Fluid dynamics of the system will be periodic and hence cause the movement of the rod 26 to become vibratory. The vibrations will be primarily transverse to the rod 26. The vibrations created will be proportionally to the Reynolds number of the fluid flowing past the rod 26 and have a magnitude that is sufficiently high to assist in freeing a fish 12 by vibrating the fish 12. The vibration of the fish 12 occurs because the housing 22 is coupled to the grapple 16, which then is in solid communication with the fish 12 (since the fish must be strongly enough held to make the trip out of the borehole). The fish 12 then vibrates at the same frequency and near the same magnitude as the rod 26. Vibrations assist in loosening a stuck fish 12, hence the prior art usage of jars to vibrate the string 20.

In the embodiment of FIG. 3, it will be appreciated that additional rods 26 in different orientations than the first rod 26 may be employed. In this case, the second rod 6 will also generate vibrations but at a different orientation than the first rod 26. Further rods 26 may also be added. Vibrations occurring in different orientations will further assist in loosening the stuck fish 12.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combination" is inclusive of blends, mixtures, alloys, reaction products, and the like. Furthermore, the terms "first," "second," and the like, herein do not denote any order, quantity, or importance, but rather are used to distinguish one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A fishing tool comprising:

a grapple;

an exciter having:

a housing in vibration transmissive communication with the grapple; and a rod having an axis, the rod mounted in the housing with the axis of the rod transverse to an axis of the housing, the rod having a cross sectional shape that produces vortex shedding upon fluid flow thereacross.

2. A fishing tool as claimed in claim 1 wherein the exciter is fluid flow based.

3. A fishing tool as claimed in claim 1 wherein the rod extends at right angles to a longitudinal axis of the housing.

4. A fishing tool as claimed in claim 1 wherein the rod extends at an angle to an axis of the housing.

5. A fishing tool as claimed in claim 1 wherein the rod has a circular cross sectional geometry.

6. A fishing tool as claimed in claim 1 wherein the rod has a square cross sectional geometry.

7. A fishing tool as claimed in claim 1 wherein the rod comprises a relatively high modulus material.

8. A fishing tool as claimed in claim 1 wherein the rod comprises ceramic material.

9. A fishing tool as claimed in claim 1 wherein the rod has a cross sectional area of about 10 percent to about 80 percent of a cross sectional area of a flow channel in which the rod is disposed.

10. A method for retrieving a stuck fish in a borehole comprising:

running the tool as claimed in claim 1 into a borehole having a stuck fish;

engaging the fish with the grapple;

actuating the exciter;

vibrating the fish.

11. A method as claimed in claim 10 wherein the actuating of the exciter comprises flowing a fluid through the exciter.

12. A method as claimed in claim 11 wherein the flowing of the fluid causes a periodic oscillation in a rod of the exciter thereby generating vibrations having an orientation.

13. A method as claimed in claim 12 wherein the flowing is over more than one rod.

14. A method as claimed in claim 13 wherein the more than one rod is oriented differently than another rod.

15. A method as claimed in claim 10 wherein the method further comprises retrieving the fish.

* * * * *